US005730328A

United States Patent [19]

Maeder et al.

[11] Patent Number: 5,730,328

[45] Date of Patent: Mar. 24, 1998

[54] DOUBLE WALL DISPENSING CONTAINER INCLUDING A COLLAPSIBLE TRELLIS INSERT

[75] Inventors: Alexandre Maeder, Pfaeffikon; Josef Ruegg, Rueti; Thomas Soltermann, Winterthur, all of Switzerland

[73] Assignee: Praezisions-Werkzeuge AG, Rueti, Switzerland

[21] Appl. No.: 476,448

[22] Filed: Jun. 7, 1995

[51] Int. Cl.[6] ..... B65D 35/28

[52] U.S. Cl. ..... 222/95; 222/464.2

[58] Field of Search ..... 222/95, 386.5, 222/464.2

[56] References Cited

U.S. PATENT DOCUMENTS

| | | | |
|---|---|---|---|
| 3,257,036 | 6/1966 | Micallef | 222/464.2 X |
| 3,490,655 | 1/1970 | Ledgett | 222/464.2 X |
| 4,159,790 | 7/1979 | Bailey | 222/464.2 X |
| 4,634,028 | 1/1987 | De Larosiere | 222/464.2 |
| 5,156,300 | 10/1992 | Spahni et al. | 222/464.2 X |
| 5,178,021 | 1/1993 | Kosuth | 222/464.2 X |

*Primary Examiner*—Gregory L. Huson

*Attorney, Agent, or Firm*—Helfgott & Karas, P.C.

[57] ABSTRACT

A trellis insert for use in an inner container of a pressurized double wall pressure container used to propel liquids from the container. The trellis prevents undesirable collapse of the inner container so as to provide controlled amounts of residual product when the inner container is collapsed.

12 Claims, 3 Drawing Sheets

DOUBLE WALL DISPENSING CONTAINER INCLUDING A COLLAPSIBLE TRELLIS INSERT

FIELD OF THE INVENTION

This invention relates to an improvement in pressurized liquid dispensers.

Double-wall packaging is well-known and is characterized by a single outer container, which can be pressure-sealed by means of a conventional valve. The deformable inner container is generally attached to the outer container in a groove located in the outer container and allows a maximum use of the available space.

Double-wall containers in which the inner container comprises a foldable synthetic pouch or bag, are also known. This synthetic bag is directly fastened to the valve casing and in a simple manner permits an ideal ratio between the volume for the contents and the volume for the propellant.

However, it has been found with this type of pressurized container, that the inner container undesirably empties inconsistently, i.e. an indefinite amount of the content remains in the inner container after exhausting the propellant. In particular, this appears to occur when, during discharge of the contents, the most easily deformable middle part of the inner container has collapsed thereby causing a local constriction of the inner container. This disadvantage is particularly relevant with technical fluids because their usage often requires that predetermined quantities be discharged.

It has therefore also been suggested to insert a dip tube into the flexible inner containers, which requires apertures along the entire container length in order to prevent such local constrictions. Such dip tubes are, however, not suitable for use with viscous fluids or pasty contents, such as, for example, silicons or greases, because the compression pressure in the interior of the pressure container is not sufficient to overcome the flow-resistance of these technical fluids and to force these through the relatively long and thin dip tube.

A further disadvantage is apparent in the fact that the inner bag or pouch cannot be attached to the valve body for reasons of material processing, but must be attached to the dip tube. This causes the inner bag to be situated relatively low within the outer container, thereby undesirably limiting the available space for the contents.

SUMMARY OF THE INVENTION

The present invention relates to a trellis insert for the inner pouch of a double-wall container having a valve, as is used in the dispensing of fluid products, such as cosmetic and technical fluid products. In addition, the invention relates to an inner bag with a squeezable trellis and its use in pressure-resistant containers, in particular pressurized cans, bottles and other dispensers.

Double-wall containers, suitable for use with the squeezable trellis of the present invention, are most commonly found in the food and technical liquid products industries. The products are generally viscous fluids or pasty and/or gel-like products. The products are stored in collapsible inner containers, not visible to the consumer. These inner containers can, for example, be made of thin aluminum inserts or foldable plastic bags and are inserted into pressure-resistant outer containers. During discharge the contents are pressed out of the inner container by means of a highly pressurized, gaseous propellant situated between the inner and outer containers. This not only facilitates the controlled dispensing of the contents, but also protects the contents from undesirable chemical reactions with ambient air and allows the exterior of the packaging to be used in its characteristic form.

It is an object of the present invention to overcome the deficiencies of the prior art and to provide means for the use of known double-wall containers for dispensing of food, technical liquids or other viscous products. It is a further object of the present invention to provide means for dependably allowing the residual contents of each container to remain constant.

According to the present invention, the objects of the invention are attained by providing the inner container with a squeezable trellis.

The squeezable trellis in its most general form comprises a multitude of openings situated on a cylindrical trellis body, the openings being dimensioned according to the flow properties of the contents. The mouthpiece of the cylindrical trellis body comprises a suitably formed collar for attachment to the outer container. In one preferred embodiment of the present invention, an attachment zone is provided between the formed collar and the trellis body with openings to assure fastening of the inner bag to the squeezable trellis. The openings in the trellis body are in the form of slits. In addition, the base of the trellis body is perforated and in one embodiment of the invention comprises two crossed braces. In another preferred embodiment of the present invention, the inner bag is welded to the attachment zone in order to assure a pressure-resistant connection between the inner bag and the squeezable trellis. In a further development of the embodiment according to the present invention, the slits have asymmetrical shapes, which facilitates their production and allows the flow-properties of the fluids to be influenced by these slits.

The advantage of the squeezable trellis of the present invention is the controlled dispensing of a predetermined amount of the container's contents. The individual dimensioning of the trellis body and its openings allow for an optimization of the expelling pressure depending on the volume ratio of the double-chamber container and the viscosity of the contents.

It is understood that modifications to the configuration of the squeezable trellis lie within the normal technical scope of one skilled in the art. In particular, the base of the squeezable trellis can be completely open and dimensioned such that this part is first squeezed together.

Figure 1:
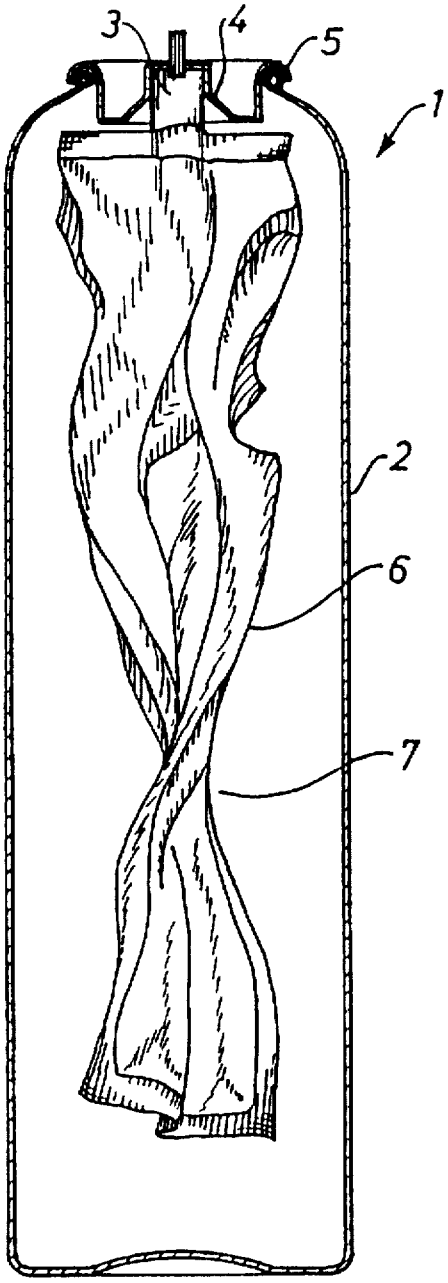
Fig. 1 PRIOR ART
FIG. 1 is a schematic longitudinal section through a conventional double-chamber container with a partially empty inner container.

FIG. 1 shows a double-wall pressure container (1) having a form-stable outer container (2) and a valve (3), which is attached to a valve plate (4). Valve plate (4) provides a pressure-tight seal in outer container (2). A rim (5) secures the pressure-tight connection between the valve plate (4) and the outer container (2). The inner container as shown in this drawing comprises an aluminum bag (6) which is attached at its upper closure to the valve body. FIG. 1 clearly illustrates the disadvantages of known double chamber containers. In these conventional containers, the inner container collapses in an irregular and noncontrollable manner. In particular, constrictions (7) result from this method of emptying the container. The constrictions (7) undesirably restrict the emptying of the inner container (6) and results in uneven quantities of product remaining in the container after exhaustion of the propellant.

Figure 2:
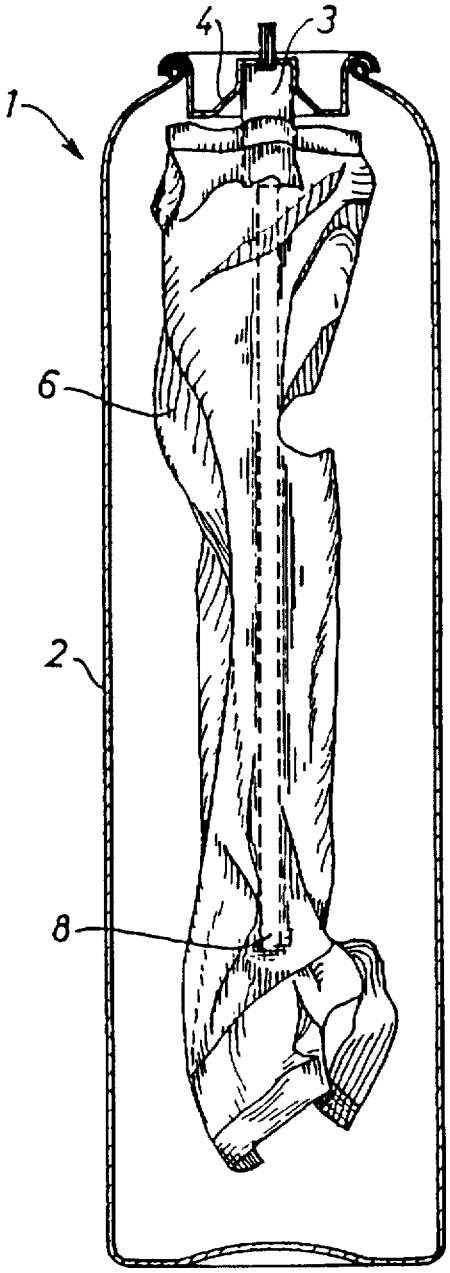
Fig. 2 PRIOR ART
FIG. 2 is a schematic longitudinal section through a conventional double-chamber container with a partially empty inner container having a dip tube.

There is no substantial improvement by use of double chambered containers (2), in which the valve (3) is provided with an interior dip tube (8). FIG. 2 illustrates such a double-chambered container which is also tightly pressure sealed by means of a valve plate (4). The clinched-in valve (3) comprises a dip-tube (8), which in a further development, has perforations over its entire length. It has also been shown in this type of can that the content remaining is not uniform. In particular this can is not suitable for dispensing pasty or gel-like products such as, for example, silicon or technical greases.

Figure 3:
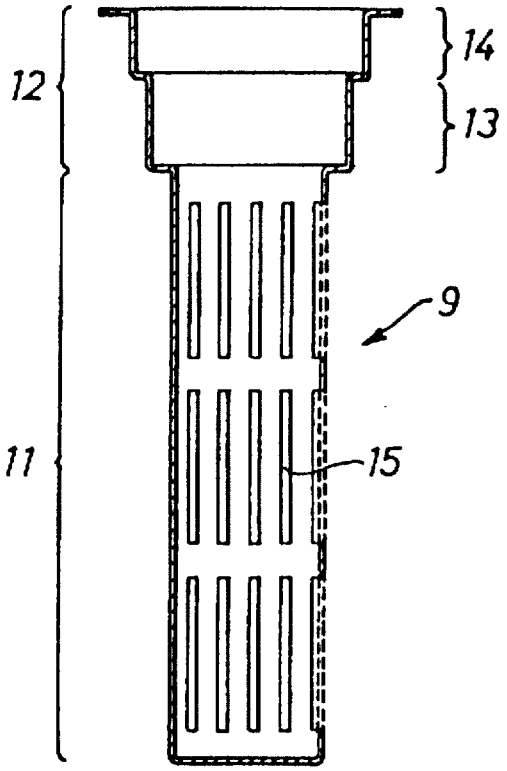
FIG. 3 is a schematic view of a squeezable trellis according to the present invention.

FIG. 3 shows a preferred embodiment of a squeezable trellis (9) of the present invention having a beaker-shaped trellis body (11) and a mouthpiece (12) which essentially comprises an attachment zone (13) for the inner bag (6) and a collar 14. Trellis body (11) comprises slits (15) which are dimensioned according to the physical characteristics of the product. It is understood that slits (15) can also be formed horizontally or can be spread over the trellis body in such a manner as to predetermine the rate of its collapse. In particular, slits (15) can be of any shape and can be spread over the trellis body in any manner. Equally, attachment zone (13) can be formed so that a pressure-resistant connection between squeezable trellis (9) and inner bag (6) can be assured. In particular, the materials can be chosen so that they can easily be glued, pressed or welded. In a preferred embodiment of the invention, the squeezable trellis is made of plastic material and is welded to a coated or laminated plastic bag. Collar (14) is fastened to outer container (2) and is dimensioned accordingly.

Figure 4:
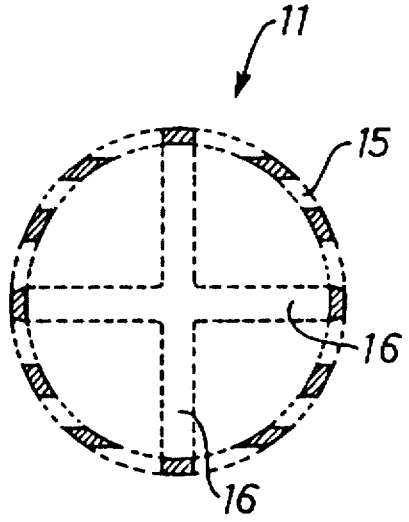
FIG. 4 is a schematic cross-sectional view through a squeezable trellis according to the present invention.

FIG. 4 shows a cross-section through a trellis body 11 according to the present invention and illustrates the asymmetrical arrangement of slit-like openings 15. These slit-like openings facilitate the inflow of product in a predetermined direction, and the flow-resistance is substantially increased in a vertical direction to the above predetermined direction. This is particularly useful where the inner container is not formed axial-symetrically but as a flat bag or pouch, which means that the contents should flow in a predetermined direction. It is understood that, in such cases, the squeezable trellis 9 and the inner bag 6 are arranged accordingly. In the illustrated embodiment, the base comprises two braces 16 arranged in a cross form. It is, however, understood that only one brace 16 can be provided or that such braces can be left out completely. It is within the scope of the invention to arrange such braces 16 anywhere within trellis body 11, in particular to influence the collapse of trellis body 11 in a desired manner.

Figure 5:
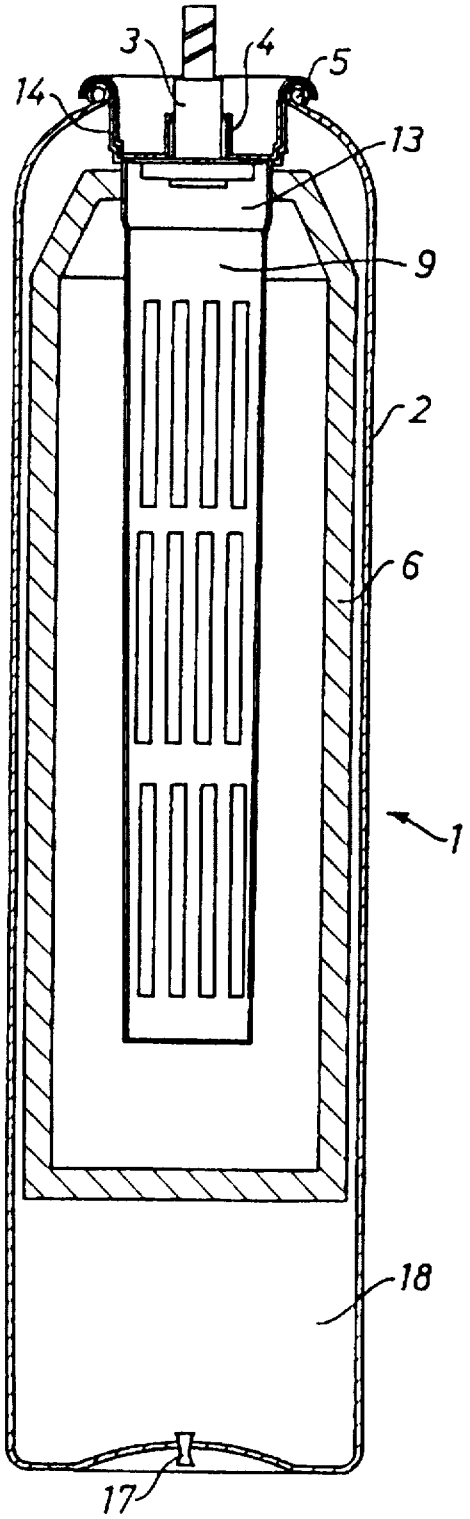
FIG. 5 is a schematic view of a can-shaped dispenser with an inner container according to the present invention.

FIG. 5 shows the use of a squeezable trellis 9 according to the present invention within a pressure container 2. Here collar 14 fits exactly on welt 5 of the outer container 2. The valve plate 4 is clinched pressure-tight with welt 5 of the outer container in a known manner. The open container 1 can be filled with the product before the valve plate is mounted, or, after attachment of the valve plate 4 can be forced through the valve 3 into the inner bag 6. The propellant is filled in known manner through a plugable hole 17 at the base. The inner bag 6 attached at the attachment zone 13 of the squeezable trellis 9 is dimensioned according to the desired volume ratios. Care must be taken that the volume of the intermediate chamber 18 receiving the propellant and the pressure produced by the propellant are sufficient to discharge the product up to a predetermined residual content. These dimensions are substantially governed by the Boyle-Mariotte law. The volume of the trellis depends upon the minimum pressure ($P_{min}$.) which is necessary to squeeze out the contents (usually a viscous or pasty gel-like product). Since the volume of the outer container is uniform and the maximum filling pressure ($P_{max}$.) is controlled, the dimension of the trellis can simply be calculated by the Boyle-Mariotte law:

$$P_{max} \times V_{filled} = P_{min} \times V_{empty} - P \times V$$

whereby:

V=volume of the chamber formed by the inner wall of outer container (2) and inner container (6)—volume of the outer container (6) minus volume of the inner container (6)

$V_{filled}$=volume V when the inner container (6) is filled $V_{empty}$=volume V when the inner container (6) is empty= $V_{trellis}$.

Figure 6:
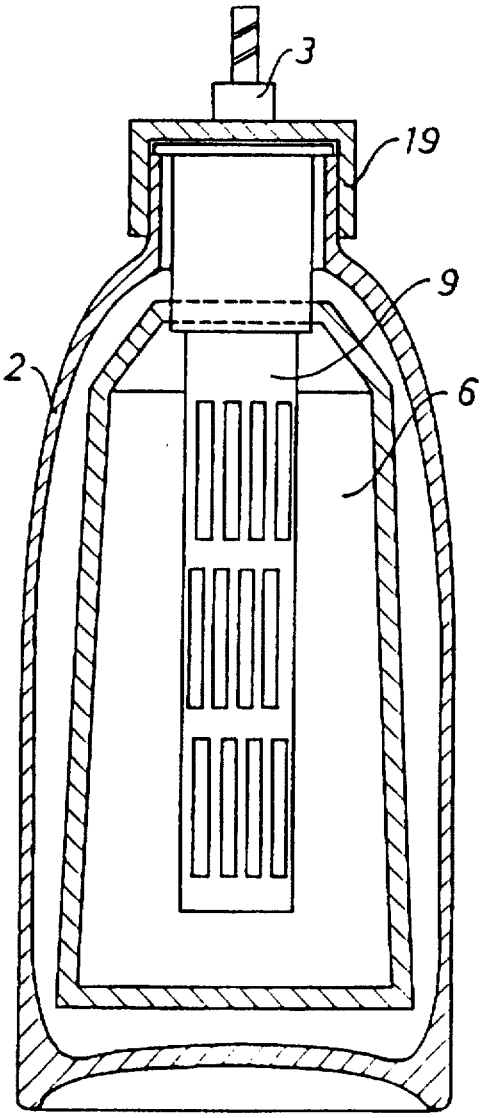
FIG. 6 is a schematic view of a bottle-shaped dispenser with an inner container according to the present invention.

FIG. 6 shows the use of the squeezable trellis 9 according to the present invention in a bottle having a screw cap.

This can be filled either directly when open and the propellant can be introduced in known manner, or in a closed state by means of the valve. The advantages of this usage are apparent and are not only to be seen in the predeterminable dispensing amount but in the simplicity of disassembly, reuse and disposal.

What is claimed is:

1. A double wall container in combination with a collapsible trellis insert for dispensing fluids under the influence of an internal expelling pressure, comprising:

an outer container having a valve for dispensing fluids therefrom;

an inner pouch disposed in the outer container; and said collapsible trellis insert including a cylindrical trellis body having a multitude of opening and a mouthpiece, the mouthpiece includes an attachment zone for attaching the trellis insert to the inner pouch and a collar for attaching the trellis insert to the outer container, wherein the trellis insert being collapsed inwardly causes the internal expelling pressure to be optimized.

2. A container according to claim 1 wherein the collar is formed directly on to the valve.

3. A container according to claim 1 wherein the attachment zone has a lens-shaped cross-section.

4. A container according to claim 1 wherein the outer container comprises a plastic bottle.

5. A container according to claim 1, wherein a volume between the outer container and the inner pouch forms an intermediate chamber filled with a propellant material and the volume of the trellis insert is calculated by the following expression:

$$Pmax*Vfilled=Pmin*Vempty-P*V,$$

wherein Vempty is the volume of the trellis insert when the intermediate chamber is empty, Pmax is the maximum expelling pressure produced by the container, Pmin is the minimum expelling pressure required to dispense liquid, V is the volume of the intermediate chamber, Vfilled is the volume of the intermediate chamber when the inner pouch is filled, Vempty is the volume of the intermediate chamber when the inner pouch is empty.

6. A container according to claim 1, wherein the trellis body further includes at least one brace for controlling the collapsing of the trellis body in a predetermined manner.

7. A container according to claim 1, wherein the trellis body further includes two braces in a cross configuration for controlling the collapsing of the trellis body in a predetermined manner.

8. A container according to claim 1 wherein the openings in said trellis body are in the form of slits.

9. A container according to claim 8 wherein said openings define a preferred pass-through direction.

10. A collapsible trellis insert in combination with a double wall container for dispensing fluids under the influence of an internal expelling pressure, the trellis insert comprising:

a lower portion in a cylindrical configuration having a multitude of openings;

an upper portion including an attachment zone for attaching the trellis insert to an inner pouch of the double wall container and a collar for attaching the trellis insert to an outer container of the double wall container; and wherein the trellis insert being collapsed inwardly causes the internal expelling pressure to be optimized.

11. A trellis insert according to claim 10, wherein the trellis body further includes at least one brace for controlling the collapsing of the trellis body in a predetermined manner.

12. A trellis insert according to claim 10, wherein the trellis body further includes two braces in a cross configuration for controlling the collapsing of the trellis body in a predetermined manner.

* * * * *